United States Patent [19]

Troncoso, Jr.

[11] Patent Number: 4,489,704

[45] Date of Patent: Dec. 25, 1984

[54] ARCHERY BOW WITH ADJUSTABLE ARROW SUPPORT

[76] Inventor: Fernando Troncoso, Jr., 14090-6100 Rd., Montrose, Colo. 81401

[21] Appl. No.: 489,694

[22] Filed: Apr. 28, 1983

[51] Int. Cl.[3] ..... F41B 5/00

[52] U.S. Cl. ..... 124/24 R; 124/41 A

[58] Field of Search ..... 124/41 A, 24 R, 88, 124/41 B

[56] References Cited

U.S. PATENT DOCUMENTS

| | | | |
|---|---|---|---|
| 2,786,461 | 3/1957 | Pelsue | 124/41 B X |
| 3,142,294 | 7/1964 | Baldwin | 124/41 B X |
| 3,871,352 | 3/1975 | Stanislawski et al. | 124/41 A |
| 4,236,497 | 12/1980 | Troncoso | 124/41 A X |
| 4,332,232 | 6/1982 | Troncoso | 124/41 A X |
| 4,344,409 | 8/1982 | Barner | 124/41 A X |
| 4,347,829 | 9/1982 | Okupniak | 124/41 A X |

*Primary Examiner*—Steven A. Bratlie
*Assistant Examiner*—William R. Browne
*Attorney, Agent, or Firm*—Donald E. Nist

[57] ABSTRACT

The assembly includes an archery bow with an arrow shelf and sidewall defining an arrow window and an arrow rest disposed in and behind the window and supporting an arrow in the window for shooting from the bow. The rest has a mounting bracket which includes a mounting arm rigidly secured at a plurality of points to the bow sidewall on the side opposite the window. The arm extends horizontally rearwardly to a point behind the bow. The arm's rear end bears a groove in which a transverse crossbar is slideably received. The crossbar has a long slot in it and a scale around the slot. A screw clamps the arm and bar together through the groove and slot. The screw can, if desired, be geared to the slot, so that rotation of the screw moves the crossbar transversely. The bar bears a rotatable post behind the window. The rear end of an arrow support is releasably locked in the post and the arrow support is seated in a horizontal slot in the post and extends forward thereof, ending in a front curved portion which holds the arrow shaft and prevents arrow roll off. The post has a return spring or magnet secured to it, as well as an adjustable collar and screw bearing against a stop pin to limit its rotation. The rest is fully adjustable to fit bows of various sizes and types.

11 Claims, 4 Drawing Figures

ARCHERY BOW WITH ADJUSTABLE ARROW SUPPORT

BACKGROUND OF THE INVENTION

1. Field of the Invention

The present invention generally relates to archery and more particularly to an improved archery bow assembly.

2. Prior Art

One common type of archery bow arrow rest is a fixed horizontal ledge attached to the bow sidewall and jutting out into the window above the handle and arrow shelf. The rest may be of feathers, leather, plastic or the like and is adapted to support an arrow in the window from below. It presents a potential problem to the archer in that the arrow feathers or vanes, and even the shaft in some instances, may strike the rest as the arrow moves forward immediately after bowstring release. Such striking slows the arrow, wears and eventually damages the vanes and rest, causes arrow wobble and reduces shooting accuracy. As the vanes or feathers wear, they also cause the arrow to change its point of impact and reduce accuracy, a critical factor in target archery and also in hunting, where the hunter may only have a few real opportunities over a several day period to make a kill. Each arrow released must be accurate.

Striking of the rest can be avoided if the rest is made narrow enough and if the arrow shaft flexes or bends laterally enough upon release of the bowstring, thus following a pronounced S-curve, as may be the case when the fingers or a finger tab or glove are used in drawing and releasing the bowstring. However, when a mechanical bowstring release is used to draw and release the bowstring, such lateral flexing is diminished very noticeably. This is even more the case when a compound archery bow is shot with a mechanical bowstring release. Moreover, a narrow rest increases the likelihood of the arrow rolling off the rest during hunting before release of the bowstring, thus causing a wild shot.

Most arrow rests cannot be adjusted sufficiently to adapt them to various types of archery shooting, to arrows of different diameters and flex characteristics and to other variables. It would be desirable to be able to impart such adaptability to an arrow rest in a simple, inexpensive manner. Most arrow rests also are not adaptable for use on a wide variety of bows of different shapes, sizes and thicknesses. Therefore, it would also be highly desirable to be able to provide a rest which could easily be adjusted to fit perfectly bows of various shapes, thicknesses and dimensions, rather than requiring an inventory of various rest sizes.

Certain arrow rests employ a hinged wire component which is held magnetically in an arrow-supporting position and bridges the gap to the sidewall but which swings forward and closes when struck by the arrow vane or feather. If such a wire is jiggled, it can prematurely close, dropping the arrow to the shelf. While such rests reduce arrow wear and deflection, those effects are still noticeably present. Archery shooting requires extreme accuracy to hit distant mobile game and other targets. Therefore, it would be highly desirable to be able to provide an improved archery assembly which could assure complete clearance of the arrow shaft and vanes from the bow upon shooting the arrow and also positive holding of the arrow to prevent its inadvertent roll off or fall through the rest.

There is also a further factor to consider. Whether the bow is shot with the bow hand held open and a finger or wrist strap used, or with a closed bow hand, during drawing of the bow the bow hand and arm are placed under considerable tension. Any inadvertent contacting of the bow hand by the arrow rest, such as by a supporting bracket for the rest, etc. will inevitably cause substantial shooting inaccuracy to arise, as well as possible injury to the bow hand. Such as also the case if the contacting occurs during or slightly after release of the bowstring during shooting. Certain arrow rests are particuarly prone to this defect. Accordingly, it would be highly desirable to provide an arrow rest which features freedom from contact of the rest with the bow hand during shooting of the bow.

Rests which tend to shift or sag or otherwise change alignment during repeated use introduce shooting errors by changing the position of the arrow in the bow from shot to shot. Therefore, it would also be desirable to provide a rest which could provide a maximum of adjustability and still be capable of easily and rigidly holding its components in proper alignment during extended use of the bow.

SUMMARY OF THE INVENTION

The improved archery bow assembly of the present invention satisfies all the foregoing needs. The assembly is substantially as set forth in the Abstract above. Thus, it includes an archery bow with arrow window, an arrow and a rest holding the arrow in the window in such a manner that the arrow will not roll off or drop through the rest and still will, upon bowstring release, shoot through the bow in an unimpeded flight without striking the rest or bow sidewall or shelf. Moreover, the rest can be adjusted to accommodate arrows and bows of all sizes, shapes, etc.

The rest includes a mounting bracket and a resilient, flexible, depressible arrow support. The bracket includes a mounting arm secured at two or more points to the sidewall of the bow opposite the window. The arm extends horizontally rearwardly to a point behind the bow to clamp a movable transverse cross arm bearing an elongated slot and scale, as well as a rotatable post. The rear portion of the arrow support is secured to the post, is seated in a horizontal groove in the post and extends forward thereof into the window to hold the arrow. The post has a return spring or magnet array and means such as a collar, screw and stop pin to limit its rotation. The arrow support preferably is of wire and includes a curved portion to prevent arrow roll off.

The assembly is simple and inexpensive, provides positive arrow and bow hand clearance and can be used equally well with arrows and bows of all sizes and types. Thus, the vertical and horizontal position of the arrow support can be adjusted. The bracket is adaptable to sidewalls and windows of various dimensions and positive locking of components assures improved accuracy shot after shot. Further features are set forth in the following detailed description and accompanying drawings.

DRAWINGS

DETAILED DESCRIPTION

FIGS. 1–4

Figure 1:
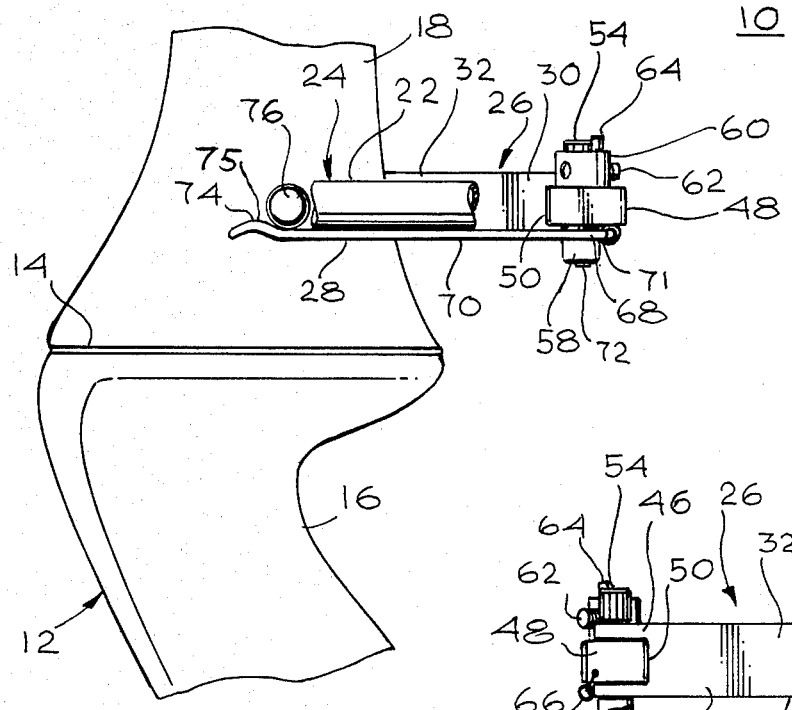
FIG. 1 is a schematic fragmentary side elevation, partly broken away, of a preferred embodiment of the improved archery bow assembly of the prsent invention, showing the window side of the bow with the improved arrow rest installed therein and holding an arrow in place.

Now referring more particularly to the accompanying drawings, an improved archery bow assembly is schematically depicted therein. Thus, assembly 10 is shown which comprises an archery bow 12 of the longbow or recurve type, compound type or the like having a shelf 14 above a handle 16, and also having a sidewall 18. The shelf 14 and sidewall 18 define a window 20 within which the shaft 22 of an arrow 24 is supported by an arrow rest 26.

Figure 3:
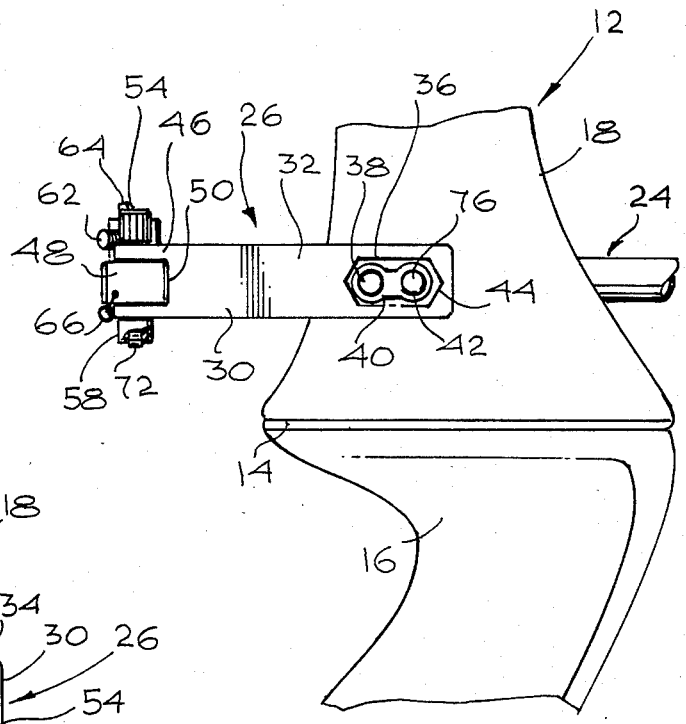
FIG. 3 is a schematic fragmentary side elevation of the improved archery bow assembly of FIG. 1, showing the side of the bow opposite that shown in FIG. 1; and, FIG. 4 is a schematic top plan view of the arrow rest of FIG. 1.

Rest 26 comprises an arrow support 28 connected to a support bracket 30. Bracket 30 includes an elongated horizontally rearwardly extending arm 32, the front end 34 of which is releasably secured to sidewall 18 on the side opposite window 20 by an enlarged nut 36 threadably disposed on a screw 38 extending transversely through sidewall 18 and an opening 40 extending transversely through arm 32 (FIG. 3). Opening 40 is dumbbell shaped and provides a second anchoring position for a second screw 42 and nut 44. The two anchoring positions assure that arm 32 will not rotate but will remain in a fixed horizontal position relative to bow 12 to assure accurate shooting. The position of arm 32 is first selected for proper arrow and hand clearance and then screws 38 and 42 and nuts 36 and 44 are installed in bow 12.

Figure 4:
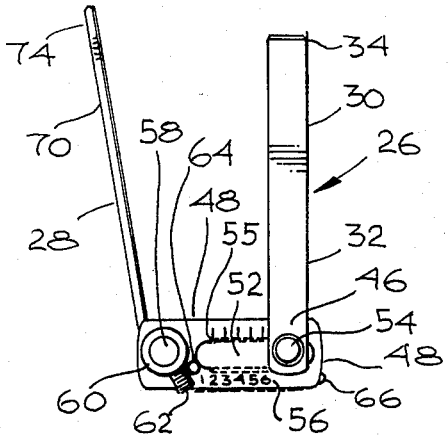

The rear end 46 of arm 32 is connected to a horizontally extending cross bar 48 disposed transversely of bow 12 behind sidewall 18. Bar 48 slides transversely through a groove 50 in end 46 and bears a longitudinal slot 52. A screw 54 passes down through end 46, groove 50 and slot 52 to releasably clamp crossbar 48 in place in end 46. If desired, screw 54 can be geared to teeth 55 bordering slot 52 (FIG. 4) so that rotation of screw 54 incrementally transversely moves bar 48. A scale 56 adjacent slot 52 allows accurate positioning and repositioning of crossbar 48 relative to arm 32. The effective width of bracket 30 can thus be controlled to properly position support 28 in window 20.

Crossbar 48 extends behind sidewall 18 to a point behind window 20 at which point a post 58 is rotatably secured thereto and extends above and below crossbar 48. Post 58 is fitted with an adjustable collar 60 bearing a lock screw 62 extending out therefrom. A stop pin 64 protrudes up from crossbar 48 adjacent collar 60. When post 58 and collar 60 are rotated, screw 62 contacts pin 64 so that the extent of such rotation is limited. A spring 66 is interconnected to post 58 and to the end of crossbar 48 which bears end 46, biasing post 58 for rotation, as shown in the drawings.

Figure 2:
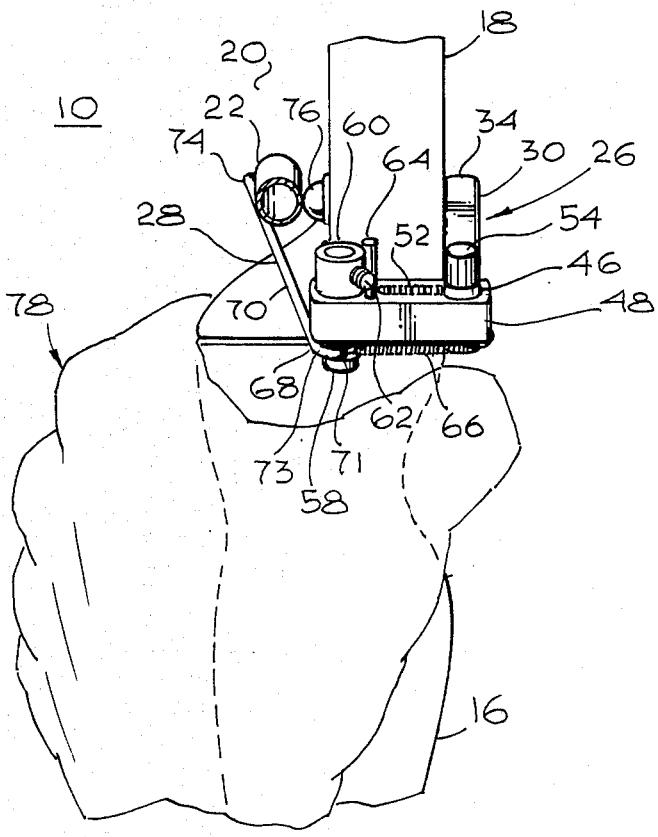
FIG. 2 is a schematic fragmentary rear perspective view, partly broken away, of the improved archery bow assembly of FIG. 1, showing a bow hand in place around the handle of the bow.

In the embodiment shown in FIGS. 1–4, post 58 receives the V-shaped rear end 68 of support 28 which support is in the form of a flexible, resilient, depressible wire 70 extending forwardly of post 58. Post 58 also has a horizontal groove 71 in which rear portion 73 of wire 70 is seated to prevent sagging of wire 70. Wire 70 is secured to post 58 by set screw 72. Front end 74 of wire 70 preferably has a rise, curve or bump 75 which assures that shaft 22 will not roll off of end 74. End 74 moves in a horizontal plane and can be positioned for proper clearance of arrow shaft 22 and vanes (not shown) by adjusting post 58 and collar 60. Thus, the spacing of shaft 22 from sidewall 18 is fully adjustable. A flexible or rigid side pressure point may also be provided for shaft 22 by securing a fixed or movable bead, cylinder or plunger 76, etc. in sidewall 18 so that it extends into window 20 and contacts the side of shaft 22, as shown in FIG. 2. Wire 70 and plunger 76 act to hold shaft 22 in place for shooting from window 20. Plunger 76 may include screw 42 so that only two holes need be drilled in bow 12.

It will be understood that rest 26 offers full adjustability vertically, horizontally, rearwardly and forwardly to allow it to fit bow 21 perfectly, regardless of the thickness of sidewall 18, depth of window 20, etc. Rest 26 easily clears the archer's bow hand 78 before, during and after shooting and is securely anchored in place on bow 12 for repeatable results.

It will also be understood that the described flexibility and adjustability of rest 26 allow various sizes and flexibilities of shaft 22 to be used with various sizes of arrow vanes and various strength bows while still providing total arrow clearance and total support of arrow 24 on rest 26, all without contacting bow hand 78. Rest 26 could be mounted in other than a horizontal plane, if desired.

Rest 26 can be fabricated of aluminum, steel and/or other metal components, as well as certain plastics, etc. in a simple, inexpensive, durable manner. Rest 26 could be used, if desired, without spring 66. Thus, screw 62 and/or pin 64 or another similar component could be made magnetic to serve the same purpose as spring 66. Alternatively, spring 66 and such magnets could be dispensed with. Moreover, wire 70 could be in the form of a curved blade or the like, if desired. Teeth 55 and the associated gearing are also option. Other changes, alterations, modifications and additions can be made in assembly 10, its components and their parameters. All such changes, modifications, alterations and additions as are within the scope of the appended claims form part of the present application.

What is claimed is:

1. An improved archery bow assembly, said assembly comprising, in combination:

A. an archery bow having a body including an arrow shelf and sidewall defining an arrow window;

B. an archery arrow having a shaft; and,

C. an improved arrow rest disposed in and behind said window and supporting said arrow in said window for shooting from said bow, said rest including i. a mounting bracket comprising a. an elongated mounting arm, b. mounting means rigidly securing said arm at a plurality of spaced points to the sidewall of said bow on the side thereof opposite said window, said arm extending horizontally rearwardly to a location immediately behind said bow body, c. a cross bar having a slot extending longitudinally therein, d. means releasably and adjustably securing said cross bar to the rear portion of said mounting arm through said slot, e. an upright post rotatably secured to said cross bar behind said window; and, f. means for controlling the limit of rotation of said post, and, ii. a flexible, resilient, depressible arrow support connected to said rotatable post and extending forwardly therefrom into said window adjacent said sidewall, the front end of said support supporting the bottom of said arrow shaft, said support front end being rotatable by said post towards and away from said window in a horizontal plane for maximum adjustability.

2. The improved bow assembly of claim 1 wherein a return spring is connected to said post to bias said post toward a given direction of rotation and wherein said post rotational limit means includes a collar releasably and adjustably secured around said post by a screw extending from said collar, and a stop pin secured to and extending from said crossbar adjacent said collar, against which said collar screw bears to limit said post's rotation.

3. The improved bow assembly of claim 1 wherein said mounting arm has at least a pair of spaced openings extending transversely therethrough and wherein said mounting means are received in said spaced openings.

4. The improved bow assembly of claim 3 wherein said mounting means comprise headed bolts or screws.

5. The improved bow assembly of claim 1 wherein said post rotational limit means comprises a collar releasably and adjustably secured around said post by a screw extending from said collar, and a stop pin secured to and extending from said crossbar adjacent said collar against which said collar screw bears to limit said post's rotation, and wherein at least one of said stop pin and screw is magnetized so that they are magnetically attracted to each other to bias the direction of rotation of said post.

6. The improved bow assembly of claim 1 wherein the rear end of said arrow support comprises a bent wire releasably secured in said post, wherein said front end of said arrow support is curved to prevent inadvertent roll off of said arrow shaft from said arrow support and wherein a rear portion of said wire rests in a horizontal groove in said post.

7. The improved bow assembly of claim 1, wherein the rear end of said mounting arm is grooved to slideably receive said crossbar, wherein said crossbar is about a right angle to said mounting arm and wherein said crossbar securing means comprises a screw passing through said mounting arm rear end, including said groove and said slot to adjustably clamp said mounting arm rear end to said crossbar.

8. The improved bow assembly of claim 7 wherein said cross bar adjacent said slot bears a scale indicating the different positions of said cross bar transversely of said mounting arm.

9. The improved bow assembly of claim 8 wherein said mounting bracket is of metal and said arrow rest is wire.

10. The improved bow assembly of claim 8 wherein said assembly includes an arrow pressure point mounted in said sidewall and extending horizontally into said window against the side of said arrow.

11. The improved bow assembly of claim 8 wherein said crossbar-securing screw is geared to said slot, whereby rotation of said crossbar-securing screw moves said crossbar transversely.

* * * * *